US010043608B2

(12) United States Patent
Sato et al.

(10) Patent No.: US 10,043,608 B2
(45) Date of Patent: Aug. 7, 2018

(54) LAMINATED COIL COMPONENT

(75) Inventors: Takahiro Sato, Tokyo (JP); Yuya Ishima, Tokyo (JP); Shusaku Umemoto, Tokyo (JP); Takashi Suzuki, Tokyo (JP); Satoru Okamoto, Tokyo (JP); Yoshikazu Sakaguchi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 14/131,948

(22) PCT Filed: Aug. 20, 2012

(86) PCT No.: PCT/JP2012/070995

§ 371 (c)(1),
(2), (4) Date: Jan. 10, 2014

(87) PCT Pub. No.: WO2013/035515

PCT Pub. Date: Mar. 14, 2013

(65) Prior Publication Data

US 2014/0145816 A1 May 29, 2014

(30) Foreign Application Priority Data

Sep. 7, 2011 (JP) ..... 2011-194911
Mar. 1, 2012 (JP) ..... 2012-045631
Mar. 1, 2012 (JP) ..... 2012-045635

(51) Int. Cl.
*H01F 5/00* (2006.01)
*H01F 27/28* (2006.01)
(Continued)

(52) U.S. Cl.
CPC ..... *H01F 5/06* (2013.01); *H01F 17/0013* (2013.01); *H01F 2017/004* (2013.01)

(58) Field of Classification Search
CPC ..... H01F 17/0013; H01F 17/0006; H01F 27/2804; H01F 17/0033; H01L 23/5227
(Continued)

(56) References Cited

U.S. PATENT DOCUMENTS 3,719,911 A * 3/1973 Tomita ..... H01F 17/04 148/312
3,949,109 A * 4/1976 McBride ..... B01D 53/86 422/211
(Continued)

FOREIGN PATENT DOCUMENTS

CN 1312565 A 9/2001
CN 101543151 A 9/2009
(Continued)

OTHER PUBLICATIONS

English-language translation of the International Preliminary Report on Patentability issued in International Application No. PCT/JP2012/070995 dated Mar. 12, 2014.
(Continued)

*Primary Examiner* — Mangtin Lian
*Assistant Examiner* — Kazi Hossain
(74) *Attorney, Agent, or Firm* — Oliff PLC

(57) ABSTRACT

A laminated coil component includes an element assembly formed by laminating a plurality of insulation layers and a coil unit formed inside the element assembly by a plurality of coil conductors. The element assembly includes a coil unit arrangement layer which has the coil unit arranged therein, and at least a pair of shape retention layers which is provided to have the coil unit arrangement layer interposed therebetween to retain a shape of the coil unit arrangement layer. The shape retention layer is made from glass-ceramic containing SrO, and a softening point of the coil unit
(Continued)

arrangement layer is lower than a softening point or a melting point of the shape retention layer.

3 Claims, 7 Drawing Sheets

(51) Int. Cl.
*H01F 27/24* (2006.01)
*H01F 5/06* (2006.01)
*H01F 17/00* (2006.01)

(58) Field of Classification Search
USPC ..... 336/200, 208, 233, 234
See application file for complete search history.

(56) References Cited

U.S. PATENT DOCUMENTS 4,495,820 A * 1/1985 Shimada ..... G01L 9/0073 257/419
4,959,631 A * 9/1990 Hasegawa ..... H01F 17/0006 336/180
6,403,200 B2 6/2002 Chikagawa et al.
6,426,551 B1 7/2002 Kawakami et al.
6,545,768 B1 4/2003 Matsubara et al.
7,839,651 B2 * 11/2010 Nishizawa ..... 361/763
7,880,092 B2 * 2/2011 Nishizawa ..... 174/255
2001/0030059 A1 * 10/2001 Sugaya et al. ..... 174/256
2001/0031690 A1 * 10/2001 Chikagawa et al. ..... 501/32
2002/0027282 A1 * 3/2002 Kawakami et al. ..... 257/700
2002/0109571 A1 * 8/2002 Fujiwara et al. ..... 336/178
2004/0070903 A1 * 4/2004 Nagai et al. ..... 361/58
2009/0011249 A1 * 1/2009 Sakamoto ..... 428/428
2009/0046441 A1 * 2/2009 Funaya et al. ..... 361/783
2009/0061178 A1 * 3/2009 Sugimoto ..... 428/210
2009/0102910 A1 * 4/2009 Sako ..... B41J 2/3353 347/203
2009/0294020 A1 12/2009 Sugimoto
2010/0151217 A1 6/2010 Kanada et al.
2011/0133881 A1 * 6/2011 Nakajima ..... H01F 3/14 336/200
2013/0154786 A1 * 6/2013 Nakajima ..... H01F 5/003 336/200
2013/0222104 A1 * 8/2013 Kitamura ..... H01F 41/046 336/200

FOREIGN PATENT DOCUMENTS

JP A-10-65335 3/1998
JP H1-132194 A 2/1999
JP A-11-297533 10/1999
JP A-2001-247359 9/2001
JP A-2001-351827 12/2001
JP 2004099378 * 4/2004
JP A-2004-099378 4/2004
JP A-2005-203629 7/2005
JP 2005-268663 A 9/2005
JP 2006-237166 A 9/2006
JP 2009-108421 A 5/2009
JP A-2010-147101 7/2010
TW 511416 11/2002

OTHER PUBLICATIONS

International Search Report issued in International Patent Application No. PCT/JP2012/070995 dated Nov. 20, 2012.

* cited by examiner

LAMINATED COIL COMPONENT

TECHNICAL FIELD

The present invention relates to a laminated coil component.

BACKGROUND ART

A laminated coil component in the related art is disclosed, for example, in Patent Literature 1. In the laminated coil component, a conductive pattern of a coil conductor is formed on a glass-ceramic sheet, each of the sheets is laminated, the coil conductors in the sheets are electrically connected with each other, the resultant body is baked, and thus an element assembly is formed to have a coil unit arranged therein. In addition, external electrodes are formed on both end surfaces of the element assembly to be electrically connected with end portions of the coil unit.

CITATION LIST

Patent Literature

[Patent Literature 1] Japanese Unexamined Patent Application Publication No. 11-297533

SUMMARY OF INVENTION

Technical Problem

Herein, a laminated coil component has a lower Q (quality factor) value compared to a wound coil obtained by winding wires due to reasons such as the structure of the laminated coil component or a method of manufacturing the laminated coil component. However, as a component is required in recent years which can particularly cope with a high frequency, a high Q value is required even for a laminated coil component. A laminated coil component in the related art cannot achieve a Q value high enough to satisfy such a demand.

The present invention is made to solve such a problem, and an object of the present invention is to provide a laminated coil component which can have a high Q value.

Solution to Problem

Smoothness of the surface of a coil conductor is preferably improved to increase a Q value of a coil. The inventors find it effective to make a ceramic of an element assembly amorphous to improve smoothness of the surface of a coil conductor. When an element assembly is crystalline, concavity and convexity of the surface of a coil conductor become large due to concavity and convexity of the surface of the element assembly in contact therewith, and thus smoothness is deteriorated (for example, refer to FIG. 3(*a*)). On the other hand, when an element assembly is amorphous, the surface of a coil conductor becomes smooth due to a smooth surface of the element assembly in contact therewith, and thus smoothness is improved (for example, refer to FIG. 3(*b*)).

Herein, when a softening point is lowered to make an element assembly amorphous, the inventors find a problem that the entirety of the element assembly is softened, and thus a shape of the element assembly becomes round (for example, refer to FIG. 4(*b*)) and is not retained. As a result of intensive research, the inventors come to find the following configuration of a laminated coil component.

A laminated coil component according to an aspect of the present invention includes an element assembly formed by laminating a plurality of insulation layers, and a coil unit formed inside the element assembly by a plurality of coil conductors. The element assembly includes a coil unit arrangement layer which has the coil unit arranged therein, and at least a pair of shape retention layers which is provided to have the coil unit arrangement layer interposed therebetween to retain a shape of the coil unit arrangement layer. The shape retention layer is made from glass-ceramic containing SrO, and, in the coil unit arrangement layer, a softening point of the coil unit arrangement layer is lower than a softening point or a melting point of the shape retention layer.

In the laminated coil component, the element assembly includes the coil unit arrangement layer which has the coil unit arranged therein, and the shape retention layer which has the coil unit arrangement layer interposed therebetween. Since the shape retention layer is made from glass-ceramic containing SrO, a softening point or a melting point is high. On the other hand, a softening point of the coil unit arrangement layer is set to be lower than a softening point or a melting point of the shape retention layer to make the coil unit arrangement layer amorphous. Since the coil unit arrangement layer of which a softening point is lowered in this way is interposed between the shape retention layers, a shape of the coil unit arrangement layer does not become round and is retained during baking. Herein, when material for increasing a softening point diffuses from the shape retention layer to the coil unit arrangement layer during baking, a softening point of the coil unit arrangement layer cannot be lowered and the coil unit arrangement layer cannot become amorphous. However, since SrO has no characteristics of diffusion, it can be prevented that a softening point of the coil unit arrangement layer is raised by the diffusion of SrO from the shape retention layer during baking. Accordingly, the coil unit arrangement layer can reliably become amorphous. As described above, when the coil unit arrangement layer becomes amorphous, smoothness of the surface of the coil conductor can be improved, and thus a Q value of the laminated coil component can be increased.

In addition, in the laminated coil component, the coil unit arrangement layer may contain 86.7 weight % to 92.5 weight % of $SiO_2$. Accordingly, dielectric constant of the coil unit arrangement layer can be decreased.

In addition, in the laminated coil component, the coil unit arrangement layer may contain 0.5 weight % to 2.4 weight % of $Al_2O_3$. Accordingly, crystal transition of the coil unit arrangement layer can be prevented.

A laminated coil component according to another aspect of the present invention includes an element assembly formed by laminating a plurality of insulation layers, and a coil unit formed inside the element assembly by a plurality of coil conductors. The element assembly includes an amorphous coil unit arrangement layer which has the coil unit arranged therein and is made from glass-ceramic, and a crystalline shape retention layer which retains a shape of the coil unit arrangement layer and is made from glass-ceramic.

In the laminated coil component, the element assembly includes the coil unit arrangement layer which has the coil unit arranged therein and the shape retention layer which retains a shape of the coil unit arrangement layer. Since the shape retention layer is a crystalline layer which is made from glass-ceramic, the shape retention layer is not softened during baking process. Accordingly, the shape retention layer can retain a shape even during baking. On the other hand, since the coil unit arrangement layer is an amorphous layer which is made from glass-ceramic, the coil unit arrangement layer is prone to be softened during baking. However, since the element assembly has not only the coil unit arrangement layer but also the shape retention layer, the coil unit arrangement layer is supported by the shape retention layer during baking, and thus a shape of the coil unit arrangement layer does not become round and is retained during baking. As described above, when the coil unit arrangement layer becomes amorphous while a shape is retained during baking, smoothness of the surface of the coil conductor can be improved, and thus a Q value of the laminated coil component can be increased.

In addition, in the laminated coil component, the shape retention layer may contain 20 weight % to 80 weight % of $Al_2O_3$. Accordingly, the shape retention layer can be kept crystalline.

In addition, in the laminated coil component, the shape retention layer may contain SrO or BaO. Accordingly, the shape retention layer can be baked at a low temperature.

In addition, in the laminated coil component, a pair of shape retention layers may have the coil unit arrangement layer interposed therebetween. Accordingly, a shape retention effect can be increased by the shape retention layer.

Herein, the inventors find a possibility that, when the element assembly becomes amorphous, strength of the element assembly becomes weak, and thus cracking or chipping is caused by external stress or impact. As a result of intensive research, the inventors come to find the following configuration of a laminated coil component.

A laminated coil component according to still another aspect of the present invention includes an element assembly formed by laminating a plurality of insulation layers, and a coil unit formed inside the element assembly by a plurality of coil conductors. The element assembly includes an amorphous coil unit arrangement layer which has the coil unit arranged therein and is made from glass-ceramic; a crystalline reinforcement layer which reinforces the coil unit arrangement layer and is made from glass-ceramic; and a stress relaxation layer which is formed between the coil unit arrangement layer and the reinforcement layer, and has a higher porosity than other portions.

In the laminated coil component, the element assembly includes the coil unit arrangement layer which has the coil unit arranged therein, and the reinforcement layer which reinforces the coil unit arrangement layer. Since the coil unit arrangement layer is an amorphous layer which is made from glass-ceramic, smoothness of the surface of the coil conductor arranged therein can be improved, and thus a Q value of the laminated coil component can be increased. In addition, since the reinforcement layer is a crystalline layer which is made from glass-ceramic, the amorphous coil unit arrangement layer can be reinforced. Furthermore, the element assembly includes the stress relaxation layer between the coil unit arrangement layer and the reinforcement layer. Since the stress relaxation layer has a higher porosity than other portions, the stress relaxation layer can mitigate stress exerted on the element assembly with being interposed between the coil unit arrangement layer and the reinforcement layer. Accordingly, a Q value of the laminated coil component can be improved and resistance to stress can be increased.

In addition, in the laminated coil component, porosity of the stress relaxation layer may be 8% to 30%. When porosity of the stress relaxation layer is within this range, a stress relaxation performance can be sufficiently ensured. In addition, when porosity is excessively large, deterioration over time or insufficient strength is caused by absorption of moisture. However, when porosity of the stress relaxation layer is equal to or less than 30%, deterioration over time or insufficient strength can be restrained.

In addition, in the laminated coil component, the coil unit arrangement layer may contain 0.7 weight % to 1.2 weight % of $K_2O$. Accordingly, a sintering can be carried out at a low temperature and the coil unit arrangement layer can become amorphous.

In addition, in the laminated coil component, a percentage of $K_2O$ content of the reinforcement layer may be less than a percentage of $K_2O$ content of the coil unit arrangement layer. Accordingly, when K diffuses from the coil unit arrangement layer to the reinforcement layer, the stress relaxation layer can be formed near the boundary portion of the coil unit arrangement layer.

Advantageous Effects of Invention

According to the present invention, a Q value of a laminated coil component can be increased.

DESCRIPTION OF EMBODIMENTS

Hereinafter, preferred embodiments of a laminated coil component according to the present invention will be described with reference to the drawings.

First Embodiment

Figure 1:
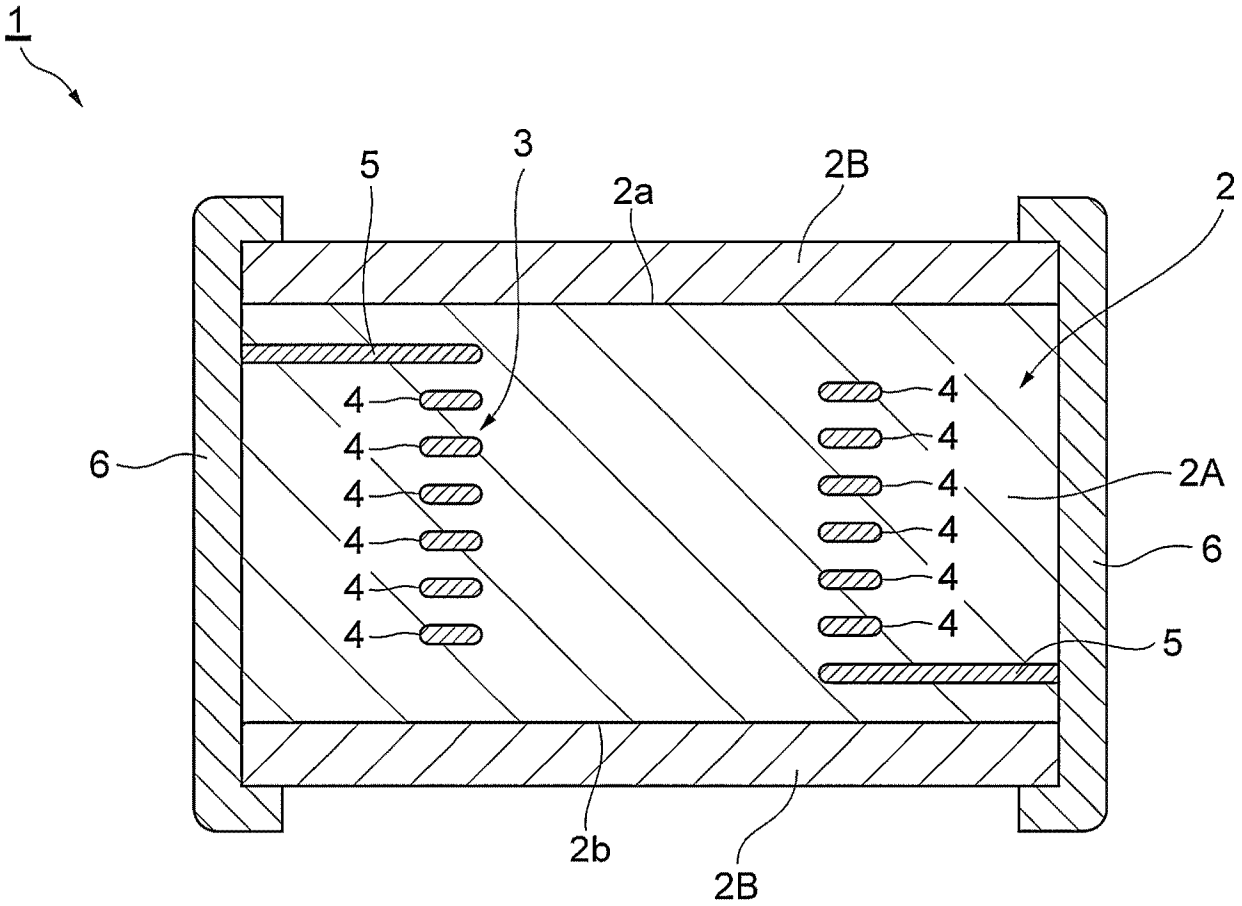
FIG. 1 is a cross-sectional view illustrating a laminated coil component according to a first embodiment and a second embodiment of the present invention.

FIG. 1 is a cross-sectional view illustrating a laminated coil component according to a first embodiment of the present invention. As illustrated in FIG. 1, a laminated coil component 1 includes an element assembly 2 formed by laminating a plurality of insulation layers, a coil unit 3 formed inside the element assembly 2 by a plurality of coil conductors 4 and 5, and a pair of external electrodes 6 formed on both end surfaces of the element assembly 2.

The element assembly 2 is a rectangular parallelepiped or cubic laminated body which consists of a sintered body obtained by laminating a plurality of ceramic green sheets. The element assembly 2 includes a coil unit arrangement layer 2A which has the coil unit 3 arranged therein and a pair of shape retention layers 2B which is provided to have the coil unit arrangement layer 2A interposed therebetween. The coil unit arrangement layer 2A and the shape retention layer 2B are made from glass-ceramic (specific composition will be described below). At least the coil unit arrangement layer 2A is made from amorphous ceramics. The shape retention layer 2B has a function of retaining a shape of the coil unit arrangement layer 2A during sintering. The shape retention layer 2B is formed to entirely cover an end surface 2*a* and an end surface 2*b* facing each other in the laminating direction among end surfaces of the coil unit arrangement layer 2A. A thickness of the coil unit arrangement layer 2A is, for example, equal to or larger than 0.1 mm in the laminating direction, and a thickness of the shape retention layer 2B is equal to or larger than 5 μm in the laminating direction.

The coil unit arrangement layer 2A contains, as main constituents, 35 weight % to 60 weight % of borosilicate glass, 15 weight % to 35 weight % of quartz and amorphous silica in the remainder, and contains alumina as an accessory constituent, and 0.5 weight % to 2.5 weight % of alumina is contained with respect to 100 weight % of the main constituents. After baking is completed, the coil unit arrangement layer 2A has a composition containing 86.7 weight % to 92.5 weight % of $SiO_2$, 6.2 weight % to 10.7 weight % of $B_2O_3$, 0.7 weight % to 1.2 weight % of $K_2O$ and 0.5 weight % to 2.4 weight % of $Al_2O_3$. When the coil unit arrangement layer 2A contains 86.7 weight % to 92.5 weight % of $SiO_2$, dielectric constant of the coil unit arrangement layer 2A can be decreased. In addition, when the coil unit arrangement layer 2A contains 0.5 weight % to 2.4 weight % of $Al_2O_3$, crystal transition of the coil unit arrangement layer 2A can be prevented. MgO or CaO (1.0 weight % or less) may be contained.

The shape retention layer 2B contains, as main constituents, 50 weight % to 70 weight % of glass and 30 weight % to 50 weight % of alumina. After baking is completed, the shape retention layer 2B has a composition containing 23 weight % to 42 weight % of $SiO_2$, 0.25 weight % to 3.5 weight % of $B_2O_3$, 34.2 weight % to 58.8 weight % of $Al_2O_3$ and 12.5 weight % to 31.5 weight % of alkaline earth metal oxide, in which 60 weight % or more of the alkaline earth metal oxide (that is, 7.5 weigh % to 31.5 weight % of the entirety of the shape retention layer 2B) is SrO.

A softening point of the coil unit arrangement layer 2A is set to be lower than a softening point or a melting point of the shape retention layer 2B. Specifically, a softening point of the coil unit arrangement layer 2A is 800 to 1,050° C., and a softening point or a melting point of the shape retention layer 2B is equal to or higher than 1,200° C. When a softening point of the coil unit arrangement layer 2A is lowered, the coil unit arrangement layer 2A can become amorphous. When a softening point or a melting point of the shape retention layer 2B is raised, a shape of the coil unit arrangement layer 2A having a low softening point is not deformed and can be retained during baking.

Since a softening point cannot be lowered when SrO is contained, SrO is not contained in the coil unit arrangement layer 2A. Herein, since SrO is difficult to diffuse, SrO of the shape retention layer 2B is restrained from diffusing to the coil unit arrangement layer 2A during baking. In addition, the coil unit arrangement layer 2A can contain $SiO_2$ having a relatively low dielectric constant by such an amount that is deficient in SrO, whereby dielectric constant can be decreased. Accordingly, a Q (quality factor) value of a coil can be increased. On the other hand, the shape retention layer 2B can contain less $SiO_2$ compared to the coil unit arrangement layer 2A by such an amount that SrO is contained, whereby dielectric constant is increased. However, the shape retention layer 2B does not contain the coil conductors 4 and 5 therein, and does not affect a Q value of a coil. In addition, the coil unit arrangement layer 2A has a large amount of $SiO_2$ and a low strength whereas the shape retention layer 2B has a small amount of $SiO_2$ and a high strength. The shape retention layer 2B can function as a reinforcement layer for the coil unit arrangement layer 2A after baking is completed.

The coil unit 3 has the coil conductor 4 related to a winding pack and the coil conductor 5 related to a lead-out portion which is connected with the external electrode 6. The coil conductors 4 and 5 are formed by a conductive paste having, for example, any of silver, copper and nickel as a main constituent. The coil unit 3 is arranged only inside the coil unit arrangement layer 2A and is not arranged in the shape retention layer 2B. In addition, none of the coil conductors 4 and 5 in the coil unit 3 are in contact with the shape retention layer 2B. Both end portions of the coil unit 3 in the laminating direction are apart from the shape retention layer 2B, the ceramic of the coil unit arrangement layer 2A is arranged between the coil unit 3 and the shape retention layer 2B. The coil conductor 4 related to a winding pack is configured by forming a conductive pattern having a predetermined winding by use of a conductive paste on the ceramic green sheet which forms the coil unit arrangement layer 2A. The conductive patterns of the layers are connected with each other via through-hole conductors in the laminating direction. In addition, the coil conductor 5 related to a lead-out portion is configured by a conductive pattern in such a manner that an end portion of a winding pattern is extended out to the external electrode 6. A coil pattern of the winding pack, the number of windings, a lead-out position of the lead-out portion or the like is not particularly specified.

A pair of external electrodes 6 is formed to cover both end surfaces facing each other in a direction orthogonal to the laminating direction among end surfaces of the element assembly 2. Each of the external electrodes 6 is formed to entirely cover each of both end surfaces and a portion thereof may go around to other four surfaces from each of both end surfaces. Each of the external electrodes 6 is formed by screen-printing a conductive paste having, for example, any of silver, copper and nickel as a main constituent, or by a dip method.

Next, a method of manufacturing the laminated coil component 1 of the above-described configuration will be described.

First, ceramic green sheets forming the coil unit arrangement layer 2A and ceramic green sheets forming the shape retention layer 2B are prepared. A ceramic paste is adjusted to have the above-described composition, is molded to have a sheet shape by a doctor blade method or the like, and each of the ceramic green sheets is prepared.

Subsequently, each of through-holes is formed by laser processing or the like at a predetermined position on each of the ceramic green sheets which become the coil unit arrangement layer 2A, that is, each of the through-holes is formed at a pre-arranged position where a through-hole electrode is formed. Next, each of the conductive patterns is formed on each of the ceramic green sheets which become the coil unit arrangement layer 2A. Herein, each of the conductive patterns and each of the through-hole electrodes are formed by a screen printing method using a conductive paste which contains silver, nickel or the like.

Subsequently, each of the ceramic green sheets is laminated. At this time, the ceramic green sheet which becomes the coil unit arrangement layer 2A is stacked on the ceramic green sheet which becomes the shape retention layer 2B, and the ceramic green sheet which becomes the shape retention layer 2B is stacked thereon. The shape retention layers 2B formed at a bottom portion and an upper portion may be formed by a piece of ceramic green sheet, or may be formed by a plurality of ceramic green sheets. Next, each of the ceramic green sheets is crimped by exerting pressure thereon in the laminating direction.

Subsequently, a laminated body is baked at a predetermined temperature (for example, approximately 800 to 1,150° C.) to form the element assembly 2. At this time, a set baking temperature is equal to or higher than a softening point of the coil unit arrangement layer 2A, and is set to be lower than a softening point or a melting point of the shape retention layer 2B. At this time, the shape retention layer 2B retains a shape of the coil unit arrangement layer 2A.

Subsequently, the external electrodes 6 are formed on the element assembly 2. Accordingly, the laminated coil component 1 is formed. An electrode paste, which has silver, nickel or copper as a main constituent, is coated on each of both end surfaces of the element assembly 2 in the longitudinal direction, baking is carried out at a predetermined temperature (for example, approximately 600 to 700° C.), and electroplating is carried out to form the external electrode 6. Cu, Ni, Sn and the like can be used for the electroplating.

Next, an operation and effect of the laminated coil component 1 according to the first embodiment will be described.

Figure 2:
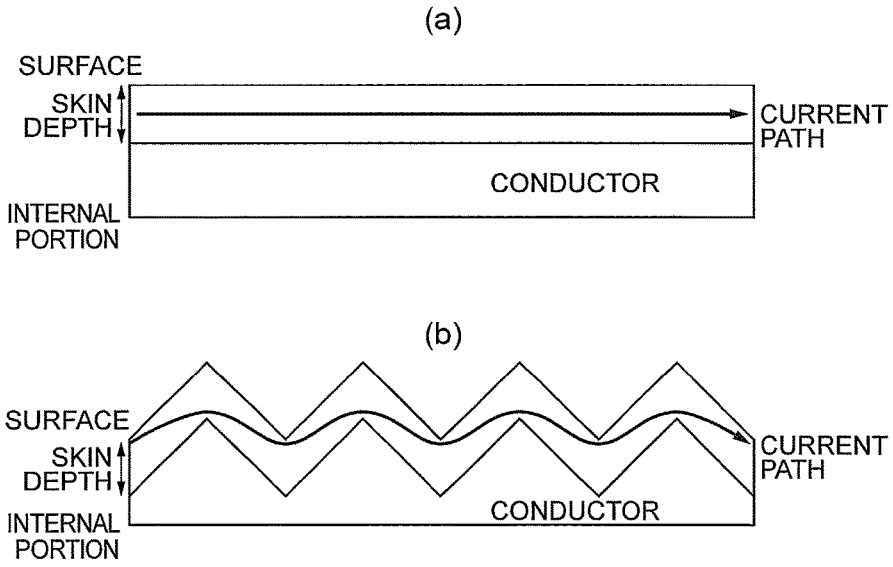
FIG. 2 is a schematic diagram illustrating a relation between smoothness and surface resistance of the surface of a coil conductor.

Smoothness of the surface of a coil conductor is preferably improved to increase a Q (quality factor) value of a coil. The higher a frequency becomes, the shallower skin depth becomes, and smoothness of the surface of a coil conductor affects a Q value at a high frequency. For example, when, as illustrated in FIG. 2(*b*), smoothness of the surface of a coil conductor is deteriorated and concavity and convexity are formed, surface resistance of the coil conductor is increased and a Q value of a coil is decreased. On the other hand, when smoothness of the surface of a coil conductor is improved as illustrated in FIG. 2(*a*), surface resistance of the coil conductor is decreased and a Q value of a coil can be increased.

Figure 3:
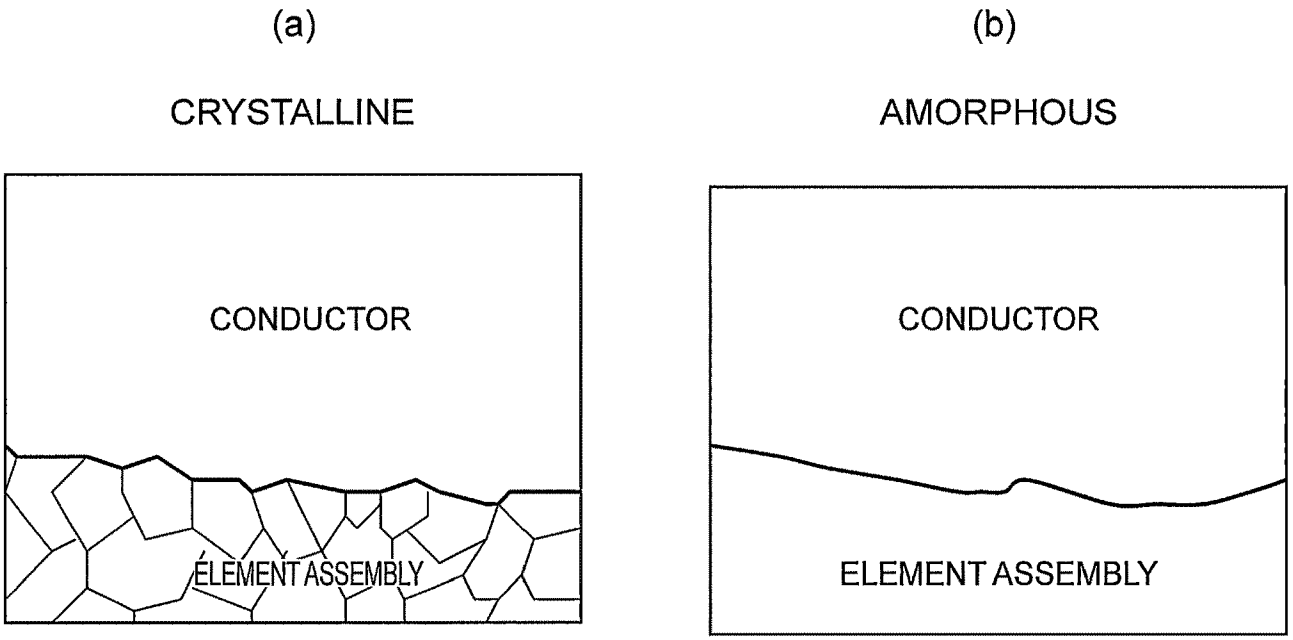
FIG. 3 is a schematic diagram illustrating a relation between a state of an element assembly and smoothness of the surface of the coil conductor.

It is effective to make a ceramic of an element assembly amorphous to improve smoothness of the surface of a coil conductor. When an element assembly is crystalline as illustrated in FIG. 3(*a*), concavity and convexity of the surface of a coil conductor becomes large due to concavity and convexity of the surface of the element assembly in contact therewith, and thus smoothness is deteriorated. On the other hand, when an element assembly is amorphous, as illustrated in FIG. 3(*b*), the surface of a coil conductor becomes smooth due to a smooth surface of the element assembly in contact therewith, and thus smoothness is improved.

Figure 4:
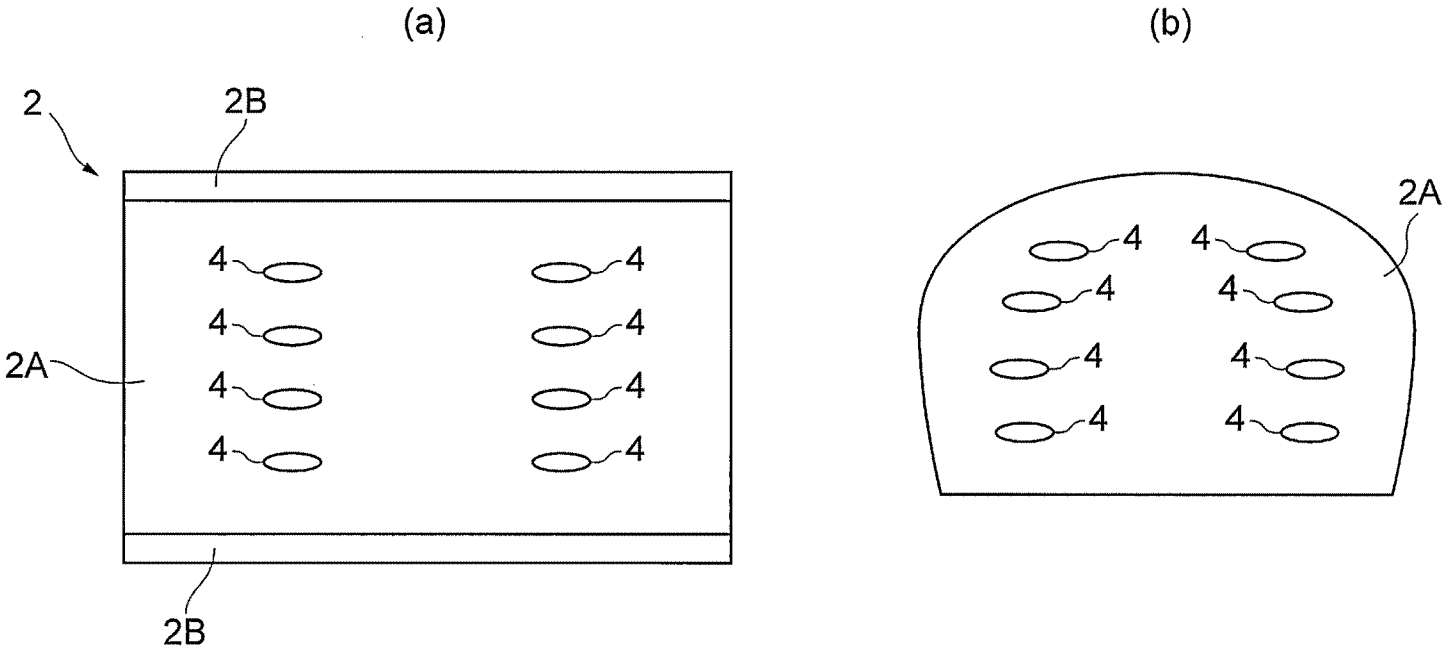
FIG. 4 is a schematic diagram illustrating states of the element assembly during baking when a shape retention layer is included and not included therein.

Herein, when a softening point is lowered to make an element assembly amorphous, the inventors find a problem that, as illustrated in FIG. 4(*b*), the entirety of the element assembly is softened, and thus a shape of the element assembly becomes round and is not retained. As a result of intensive research, the inventors come to find the configuration of the laminated coil component 1 according to the embodiment.

In the laminated coil component 1 according to the embodiment, the element assembly 2 includes the coil unit arrangement layer 2A which has the coil unit 3 arranged therein, and the shape retention layer 2B which has the coil unit arrangement layer 2A interposed therebetween. Since the shape retention layer 2B is made from glass-ceramic containing SrO, a softening point thereof is high. On the other hand, a softening point of the coil unit arrangement layer 2A is set to be lower than a softening point or a melting point of the shape retention layer 2B to make the coil unit arrangement layer 2A amorphous. Since the coil unit arrangement layer 2A of which a softening point is lowered in this way is interposed between the shape retention layers 2B, a shape of the coil unit arrangement layer 2A does not become round and is retained during baking. Herein, when material such as MgO or CaO for increasing a softening point diffuses from the shape retention layer 2B to the coil unit arrangement layer 2A during baking, a softening point of the coil unit arrangement layer 2A cannot be lowered and the coil unit arrangement layer 2A cannot become amorphous. However, since SrO has no characteristics of diffusion, it can be prevented that a softening point of the coil unit arrangement layer 2A is raised by the diffusion of SrO from the shape retention layer 2B during baking. Accordingly, the coil unit arrangement layer 2A can reliably become amorphous. As described above, when the coil unit arrangement layer 2A becomes amorphous, smoothness of the surfaces of the coil conductors 4 and 5 can be improved, and thus a Q value of the laminated coil component 1 can be increased.

In the embodiment, an element assembly is not entirely amorphous and includes a crystalline portion by such a small amount (0.5 weight % to 2.4 weight %) that alumina is contained. However, the amount is extremely small, and thus a smooth surface is obtained as illustrated in FIG. 3(*b*). As such, the term "amorphous" herein corresponds to even a case where a crystalline portion is included as far as the portion is small.

Figure 5:
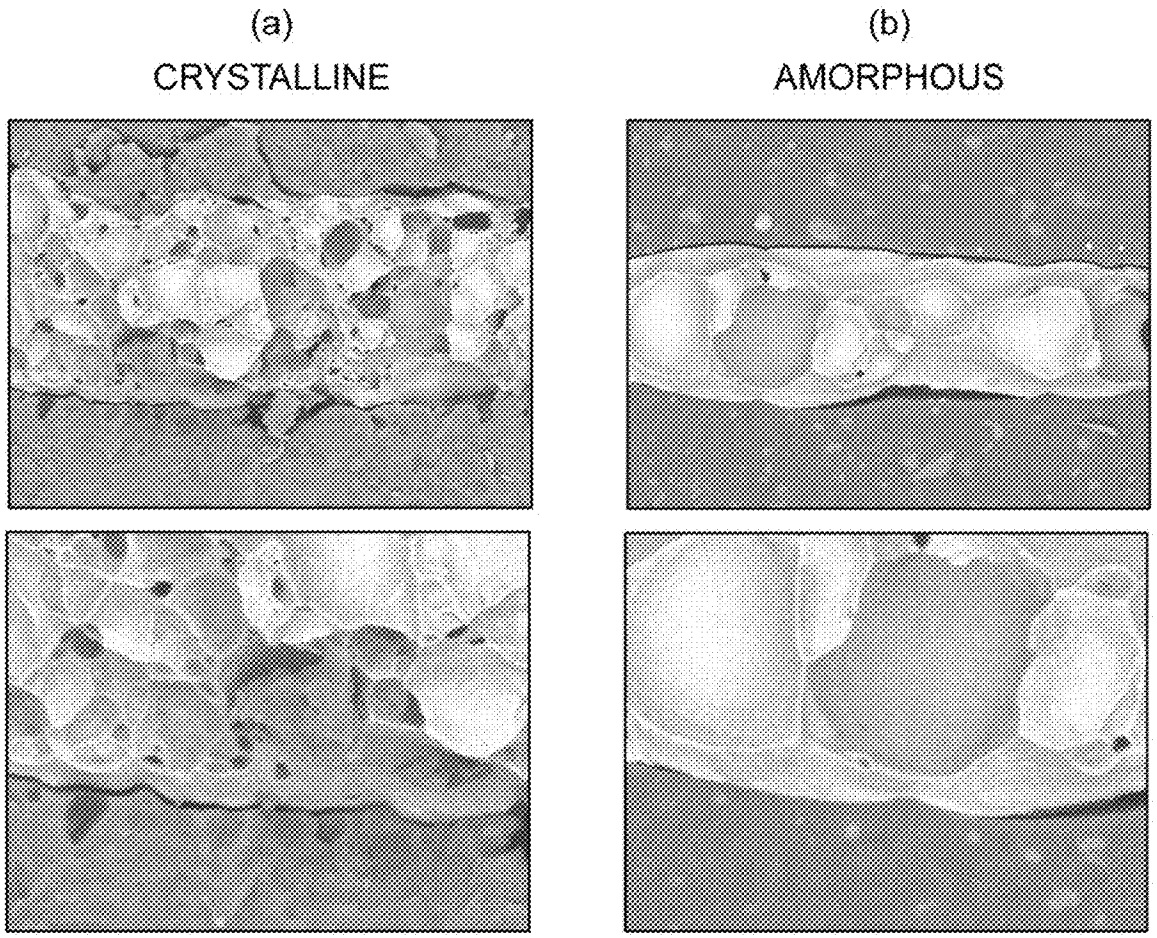
FIG. 5 shows enlarged photographs illustrating phases of the coil conductor of the laminated coil conductor and the element assembly according to an example and a comparative example of the first embodiment.

FIG. 5(*a*) shows enlarged photographs illustrating phases of a coil conductor and an element assembly of a laminated coil component according to a comparative example, and FIG. 5(*b*) shows enlarged photographs illustrating phases of a coil conductor and an element assembly of a laminated coil component according to an example.

In a laminated coil component according to the comparative example, an element assembly is crystalline. In the comparative example as illustrated in FIG. 5(*a*), an element assembly becomes crystalline, and thus smoothness of a coil conductor is deteriorated. The laminated coil component according to the comparative example is manufactured using materials and manufacturing conditions as follows. That is, a coil unit arrangement layer of the laminated coil component according to the comparative example contains, as main constituents, 70 weight % of glass and 30 weight % of alumina. After baking is completed, the coil unit arrangement layer of the laminated coil component according to the comparative example contains 1.5 weight % of $B_2O_3$, 2.1 weight % of MgO, 37 weight % of $Al_2O_3$, 32 weight % of $SiO_2$, 4 weight % of CaO, 22 weight % of SrO and 0.21 weight % of BaO. The laminated coil component according to the comparative example does not have a shape retention layer. In addition, Ag is used as material of the coil conductor. In addition, a baking temperature is set to 900° C.

On the other hand, in a laminated coil component according to the example, an element assembly is amorphous. In the example as illustrated in FIG. 5(*b*), an element assembly becomes amorphous, and thus smoothness of a coil conductor is improved. Accordingly, a high Q value can be achieved. The laminated coil component according to the example is manufactured using materials and manufacturing conditions as follows. That is, a coil unit arrangement layer of the laminated coil component according to the example contains, as main constituents, 60 weight % of borosilicate glass, 20 weight % of quartz, 20 weight % of amorphous silica and 1.5 weight % of alumina. After baking is completed, the laminated coil component according to the example contains 10.2 weight % of $B_2O_3$, 1.2 weight % of $Al_2O_3$, 87.5 weight % of $SiO_2$ and 1.1 weight % of $K_2O$. A shape retention layer of the laminated coil component according to the example contains, as main constituents, 70 weight % of glass and 30 weight % of alumina. After baking is completed, the shape retention layer of the laminated coil component according to the example contains 1.5 weight % of $B_2O_3$, 2.1 weight % of MgO, 37 weight % of $Al_2O_3$, 32 weight % of $SiO_2$, 4 weight % of CaO, 22 weight % of SrO and 0.21 weight % of BaO. In addition, Ag is used as material of the coil conductor. In addition, a baking temperature is set to 900° C.

Second Embodiment

FIG. 1 is a cross-sectional view illustrating a laminated coil component according to a second embodiment of the present invention. As illustrated in FIG. 1, the laminated coil component 1 includes the element assembly 2 formed by laminating a plurality of insulation layers, the coil unit 3 formed inside the element assembly 2 by a plurality of coil conductors 4 and 5, and a pair of external electrodes 6 formed on both end surfaces of the element assembly 2.

The element assembly 2 is a rectangular parallelepiped or cubic laminated body which consists of a sintered body obtained by laminating a plurality of ceramic green sheets. The element assembly 2 includes a coil unit arrangement layer 2A which has the coil unit 3 arranged therein and a pair of shape retention layers 2B which is provided to have the coil unit arrangement layer 2A interposed therebetween. The coil unit arrangement layer 2A and the shape retention layer 2B are made from glass-ceramics (specific composition will be described below). The coil unit arrangement layer 2A is made from amorphous ceramics. The shape retention layer 2B is made from crystalline ceramics. The shape retention layer 2B has a function of retaining a shape of the coil unit arrangement layer 2A during sintering. The shape retention layer 2B is formed to entirely cover an end surface 2*a* and an end surface 2*b* facing each other in the laminating direction among end surfaces of the coil unit arrangement layer 2A. A thickness of the coil unit arrangement layer 2A is, for example, equal to or larger than 0.1 mm in the laminating direction, and a thickness of the shape retention layer 2B is equal to or larger than 5 μm in the laminating direction.

The coil unit arrangement layer 2A contains, as main constituents, 35 weight % to 60 weight % of borosilicate glass, 15 weight % to 35 weight % of quartz and amorphous silica in the remainder, and contains alumina as an accessory constituent, and 0.5 weight % to 2.5 weight % of alumina is contained with respect to 100 weight % of the main constituents. After baking is completed, the coil unit arrangement layer 2A has a composition containing 86.7 weight % to 92.5 weight % of $SiO_2$, 6.2 weight % to 10.7 weight % of $B_2O_3$, 0.7 weight % to 1.2 weight % of $K_2O$ and 0.5 weight % to 2.4 weight % of $Al_2O_3$. When the coil unit arrangement layer 2A contains 86.7 weight % to 92.5 weight % of $SiO_2$, dielectric constant of the coil unit arrangement layer 2A can be decreased. In addition, when the coil unit arrangement layer 2A contains 0.5 weight % to 2.4 weight % of $Al_2O_3$, crystal transition of the coil unit arrangement layer 2A can be prevented. MgO or CaO (1.0 weight % or less) may be contained.

The shape retention layer 2B contains, as main constituents, 80 weight % to 20 weight % of glass and 20 weight % to 80 weight % of alumina. After baking is completed, the shape retention layer 2B has a composition containing 4.5 weight % to 28 weight % of $SiO_2$, 0.25 weight % to 20 weight % of $B_2O_3$, 20 weight % to 80 weight % of $Al_2O_3$ and 10 weight % to 48 weight % of alkaline earth metal oxide. SrO, BaO, CaO or MgO is preferable as an alkaline earth metal oxide, particularly, SrO or BaO is preferable. When the shape retention layer 2B contains 20 to 80 weight % of $Al_2O_3$, the shape retention layer 2B can be kept crystalline. When the shape retention layer 2B contains SrO or BaO, the shape retention layer 2B can be baked at a low temperature. A low-temperature baking indicates baking at a temperature of approximately 800 to 950° C.

A softening point of the coil unit arrangement layer 2A is set to be lower than a softening point or a melting point of the shape retention layer 2B. Specifically, a softening point of the coil unit arrangement layer 2A is 800 to 1,050° C., and a softening point or a melting point of the shape retention layer 2B is equal to or higher than 1,200° C. When a softening point of the coil unit arrangement layer 2A is lowered, the coil unit arrangement layer 2A can become amorphous. When a softening point or a melting point of the crystalline shape retention layer 2B is raised, a shape of the coil unit arrangement layer 2A having a low softening point is not deformed and can be retained during baking.

The coil unit 3 has the coil conductor 4 related to a winding pack and the coil conductor 5 related to a lead-out portion which is connected with the external electrode 6. The coil conductors 4 and 5 are formed by a conductive paste having, for example, any of silver, copper and nickel as a main constituent. The coil unit 3 is arranged only inside the coil unit arrangement layer 2A and is not arranged in the shape retention layer 2B. In addition, any of the coil conductors 4 and 5 in the coil unit 3 is not in contact with the shape retention layer 2B. Both end portions of the coil unit 3 in the laminating direction are apart from the shape retention layer 2B, the ceramic of the coil unit arrangement layer 2A is arranged between the coil unit 3 and the shape retention layer 2B. The coil conductor 4 related to a winding pack is configured by forming a conductive pattern having a predetermined winding by use of a conductive paste on the ceramic green sheet which forms the coil unit arrangement layer 2A. The conductive patterns of the layers are connected with each other via through-hole conductors in the laminating direction. In addition, the coil conductor 5 related to a lead-out portion is configured by a conductive pattern in such a manner that an end portion of a winding pattern is extended out to the external electrode 6. A coil pattern of the winding pack or the number of windings, a lead-out position of the lead-out portion or the like is not particularly specified.

A pair of external electrodes 6 is formed to cover both end surfaces facing each other in a direction orthogonal to the laminating direction among end surfaces of the element assembly 2. Each of the external electrodes 6 is formed to entirely cover each of both end surfaces and a portion thereof may go around to other four surfaces from each of both end surfaces. Each of the external electrodes 6 is formed by screen-printing a conductive paste having, for example, any of silver, copper and nickel as a main constituent, or by a dip method.

Next, a method of manufacturing the laminated coil component 1 of the above-described configuration will be described.

First, ceramic green sheets forming the coil unit arrangement layer 2A and ceramic green sheets forming the shape retention layer 2B are prepared. A ceramic paste is adjusted to have the above-described composition, is molded to have a sheet shape by a doctor blade method or the like and each of the ceramic green sheets is prepared.

Subsequently, each of through-holes is formed by laser processing or the like at a predetermined position on each of the ceramic green sheets which become the coil unit arrangement layer 2A, that is, each of the through-holes is formed at a pre-arranged position where a through-hole electrode is formed. Next, each of the conductive patterns is formed on each of the ceramic green sheets which become the coil unit arrangement layer 2A. Herein, each of the conductive patterns and each of the through-hole electrodes are formed by a screen printing method using a conductive paste which contains silver, nickel or the like.

Subsequently, each of the ceramic green sheets is laminated. At this time, the ceramic green sheet which becomes the coil unit arrangement layer 2A is stacked on the ceramic green sheet which becomes the shape retention layer 2B, and the ceramic green sheet which becomes the shape retention layer 2B is stacked thereon. The shape retention layers 2B formed at a bottom portion and an upper portion may be formed by a piece of ceramic green sheet, or may be formed by a plurality of ceramic green sheets. Next, each of the ceramic green sheets is crimped by exerting pressure thereon in the laminating direction.

Subsequently, a laminated body is baked at a predetermined temperature (for example, approximately 800 to 1,150° C.) to form the element assembly 2. At this time, a set baking temperature is equal to or higher than a softening point of the coil unit arrangement layer 2A, and is set to be lower than a softening point or a melting point of the shape retention layer 2B. At this time, the shape retention layer 2B retains a shape of the coil unit arrangement layer 2A.

Subsequently, the external electrodes 6 are formed on the element assembly 2. Accordingly, the laminated coil component 1 is formed. An electrode paste, which has silver, nickel or copper as a main constituent, is coated on each of both end surfaces of the element assembly 2 in the longitudinal direction, baking is carried out at a predetermined temperature (for example, approximately 600 to 700° C.), and electroplating is carried out to form the external electrode 6. Cu, Ni, Sn and the like can be used for the electroplating.

Next, an operation and effect of the laminated coil component 1 according to the second embodiment will be described.

Smoothness of the surface of a coil conductor is preferably improved to increase a Q (quality factor) value of a coil. The higher a frequency becomes, the shallower skin depth becomes, and smoothness of the surface of a coil conductor affects a Q value at a high frequency. For example, when, as illustrated in FIG. 2(*b*), smoothness of the surface of a coil conductor is deteriorated and concavity and convexity are formed, surface resistance of the coil conductor is increased and a Q value of a coil is decreased. On the other hand, when smoothness of the surface of a coil conductor is improved as illustrated in FIG. 2(*a*), surface resistance of the coil conductor is decreased and a Q value of a coil can be increased.

It is effective to make a ceramic of an element assembly amorphous to improve smoothness of the surface of a coil conductor. When an element assembly is crystalline as illustrated in FIG. 3(*a*), concavity and convexity of the surface of a coil conductor becomes large due to concavity and convexity of the surface of the element assembly in contact therewith, and thus smoothness is deteriorated. On the other hand, when an element assembly is amorphous as illustrated in FIG. 3(*b*), the surface of a coil conductor becomes smooth due to a smooth surface of the element assembly in contact therewith, and thus smoothness is improved.

Herein, when a softening point is lowered to make an element assembly amorphous, the inventors find a problem that, as illustrated in FIG. 4(*b*), the entirety of the element assembly is softened, and thus a shape of the element assembly becomes round and is not retained. As a result of intensive research, the inventors come to find the configuration of the laminated coil component 1 according to the embodiment.

In the laminated coil component 1 according to the embodiment, the element assembly 2 includes the coil unit arrangement layer 2A which has the coil unit 3 arranged therein, and the shape retention layer 2B which retains a shape of the coil unit arrangement layer 2A. Since the shape retention layer 2B is a crystalline layer which is made from glass-ceramic, the shape retention layer 2B is not softened during baking process. Accordingly, the shape retention layer 2B can retain a shape even during baking. On the other hand, since the coil unit arrangement layer 2A is an amorphous layer which is made from glass-ceramic, the coil unit arrangement layer 2A is prone to be softened during baking. However, since the element assembly 2 has not only the coil unit arrangement layer 2A but also the shape retention layer 2B, the coil unit arrangement layer 2A is supported by the shape retention layer 2B during baking, and thus a shape of the coil unit arrangement layer 2A does not become round and is retained during baking. As described above, when the coil unit arrangement layer 2A becomes amorphous while a shape is retained during baking, smoothness of the surface of the coil conductor 4 can be improved, and thus a Q value of the laminated coil component 1 can be increased.

In addition, in the laminated coil component 1 according to the embodiment, a pair of shape retention layers 2B has the coil unit arrangement layer 2A interposed therebetween. Accordingly, a shape retention effect can be increased by the shape retention layer 2B.

In the embodiment, the coil unit arrangement layer 2A is not entirely amorphous and includes a crystalline portion by such a small amount (0.5 weight % to 2.4 weight %) that alumina is contained. However, the amount is extremely small, and thus a smooth surface is obtained as illustrated in FIG. 3(*b*). As such, the term "amorphous" herein corresponds to even a case where a crystalline portion is included as far as the portion is small.

FIG. 5(*a*) shows enlarged photographs illustrating phases of a coil conductor and an element assembly of a laminated coil component according to a comparative example.

In a laminated coil component according to the comparative example, an element assembly is crystalline. In the comparative example as illustrated in FIG. 5(*a*), an element assembly becomes crystalline, and thus smoothness of a coil conductor is deteriorated. The laminated coil component according to the comparative example is manufactured using materials and manufacturing conditions as follows. A coil unit arrangement layer of the laminated coil component according to the comparative example contains, as main constituents, 70 weight % of glass and 30 weight % of alumina. After baking is completed, the coil unit arrangement layer of the laminated coil component according to the comparative example contains 1.5 weight % of $B_2O_3$, 2.1 weight % of MgO, 37 weight % of $Al_2O_3$, 32 weight % of $SiO_2$, 4 weight % of CaO, 22 weight % of SrO and 0.21 weight % of BaO. The laminated coil component according to the comparative example does not have a shape retention layer. In addition, Ag is used as material of the coil conductor. In addition, a baking temperature is set to 900° C.

On the other hand, in a laminated coil component according to an example, an element assembly is amorphous. In the example, an element assembly becomes amorphous, and thus smoothness of a coil conductor is improved. Accordingly, a high Q value can be achieved. The laminated coil component according to the example is manufactured using materials and manufacturing conditions as follows. A coil unit arrangement layer of the laminated coil component according to the example contains, as main constituents, 60 weight % of borosilicate glass, 20 weight % of quartz, 20 weight % of amorphous silica and 1.5 weight % of alumina. After baking is completed, the laminated coil component according to the example contains 10.2 weight % of $B_2O_3$, 1.2 weight % of $Al_2O_3$, 87.5 weight % of $SiO_2$ and 1.1 weight % of $K_2O$. A shape retention layer of the laminated coil component according to the example contains, as main constituents, 70 weight % of glass and 30 weight % of alumina. After baking is completed, the shape retention layer of the laminated coil component according to the example contains 1.5 weight % of $B_2O_3$, 2.1 weight % of MgO, 37 weight % of $Al_2O_3$, 25 weight % of $SiO_2$, 4 weight % of CaO, 26 weight % of SrO and 3.21 weight % of BaO. In addition, Ag is used as material of the coil conductor. In addition, a baking temperature is set to 900° C.

Third Embodiment

Figure 6:
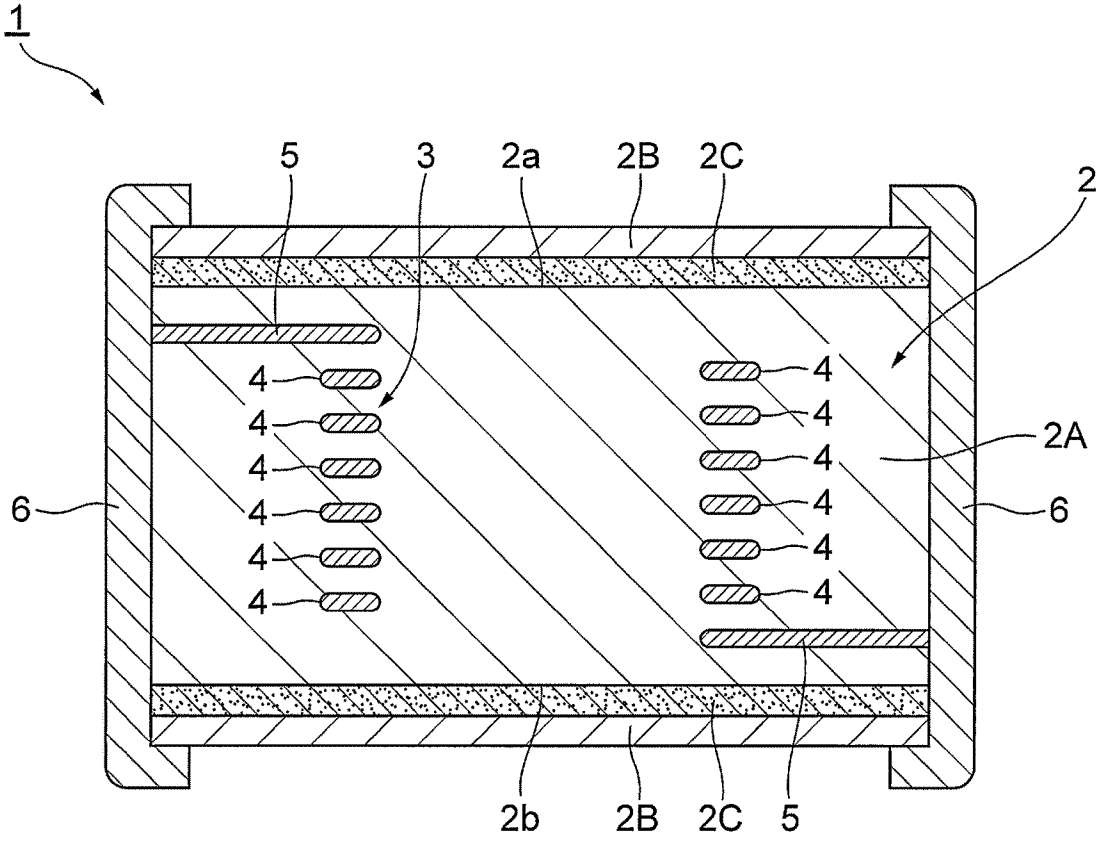
FIG. 6 is a cross-sectional view illustrating a laminated coil component according to a third embodiment of the present invention.

FIG. 6 is a cross-sectional view illustrating a laminated coil component according to a third embodiment of the present invention. As illustrated in FIG. 6, the laminated coil component 1 includes the element assembly 2 formed by laminating a plurality of insulation layers, the coil unit 3 formed inside the element assembly 2 by a plurality of coil conductors 4 and 5, and a pair of external electrodes 6 formed on both end surfaces of the element assembly 2.

The element assembly 2 is a rectangular parallelepiped or cubic laminated body which consists of a sintered body obtained by laminating a plurality of ceramic green sheets. For a size of the element assembly 2, the length is set to approximately 0.3 to 1.7 mm, the width is set to approximately 0.1 to 0.9 mm, and the height is set to approximately 0.1 to 0.9 mm. The element assembly 2 includes a coil unit arrangement layer 2A which has the coil unit 3 arranged therein; a pair of reinforcement layers 2B which is provided to have the coil unit arrangement layer 2A interposed therebetween; and a stress relaxation layer 2C which is formed between the coil unit arrangement layer 2A and the reinforcement layer 2B. The coil unit arrangement layer 2A is an amorphous layer which is made from glass-ceramic. A thickness of the coil unit arrangement layer 2A is set to 0.1 mm or more. The reinforcement layer 2B is a crystalline layer which is made from glass-ceramic. The reinforcement layer 2B has a function of reinforcing strength of the amorphous coil unit arrangement layer 2A. In addition, the reinforcement layer 2B also has a function of retaining a shape of the coil unit arrangement layer 2A during baking. A thickness of the reinforcement layer 2B is set to 5 μm or more. The stress relaxation layer 2C is a layer which has a lot of pores therein and is made from ceramics. The stress relaxation layer 2C has a function of mitigating stress exerted on the element assembly 2. A thickness of the stress relaxation layer 2C is set to approximately 10 to 25 μm. The reinforcement layer 2B is formed to entirely cover the end surface 2*a* and the end surface 2*b* facing each other in the laminating direction among end surfaces of the coil unit arrangement layer 2A. In addition, the stress relaxation layer 2C is formed between the coil unit arrangement layer 2A and the reinforcement layer 2B to entirely cover the end surface 2*a* and the end surface 2*b*.

The coil unit arrangement layer 2A contains, as main constituents, 35 weight % to 60 weight % of borosilicate glass, 15 weight % to 35 weight % of quartz and amorphous silica in the remainder, and contains alumina as an accessory constituent, and 0.5 weight % to 2.5 weight % of alumina is contained with respect to 100 weight % of the main constituents. After baking is completed, the coil unit arrangement layer 2A has a composition containing 86.7 weight % to 92.5 weight % of $SiO_2$, 6.2 weight % to 10.7 weight % of $B_2O_3$, 0.7 weight % to 1.2 weight % of $K_2O$ and 0.5 weight % to 2.4 weight % of $Al_2O_3$. When the coil unit arrangement layer 2A contains 86.7 weight % to 92.5 weight % of $SiO_2$, dielectric constant of the coil unit arrangement layer 2A can be decreased. In addition, when the coil unit arrangement layer 2A contains 0.5 weight % to 2.4 weight % of $Al_2O_3$, crystal transition of the coil unit arrangement layer 2A can be prevented. When the coil unit arrangement layer 2A contains 0.7 weight % to 1.2 weight % of $K_2O$, a sintering can be carried out at a low temperature (800 to 950° C.), and the coil unit arrangement layer 2A can become an amorphous layer. MgO or CaO (1.0 weight % or less) may be contained.

The reinforcement layer 2B contains, as main constituents, 50 weight % to 70 weight % of glass and 30 weight % to 50 weight % of alumina. After baking is completed, the reinforcement layer 2B has a composition containing 23 weight % to 42 weight % of $SiO_2$, 0.25 weight % to 3.5 weight % of $B_2O_3$, 34.2 weight % to 58.8 weight % of $Al_2O_3$ and 12.5 weight % to 31.5 weight % of alkaline earth metal oxide, in which 60 weight % or more of the alkaline earth metal oxide (that is, 7.5 weight % to 31.5 weight % of the entirety of the reinforcement layer 2B) is SrO.

The stress relaxation layer 2C is a ceramic layer having a higher porosity compared to the coil unit arrangement layer 2A and the reinforcement layer 2B. Porosity of the stress relaxation layer 2C is preferably 8 to 30%, more preferably 10 to 25%. When porosity of the stress relaxation layer 2C is within this range, a stress relaxation performance can be sufficiently ensured. In addition, when porosity is excessively large, deterioration over time or insufficient strength is caused by absorption of moisture. However, when porosity of the stress relaxation layer 2C is equal to or less than 30%, more preferably equal to or less than 25%, deterioration over time or insufficient strength can be restrained. The term "porosity" is a value determined by calculating a percent of pores (an area occupied by pores with reference to an entire area of the field of view observed) shown in the field of view observed of the stress relaxation layer 2C when a SEM image of the fracture surface of a ceramic is image-analyzed after baking is completed.

Figure 7:
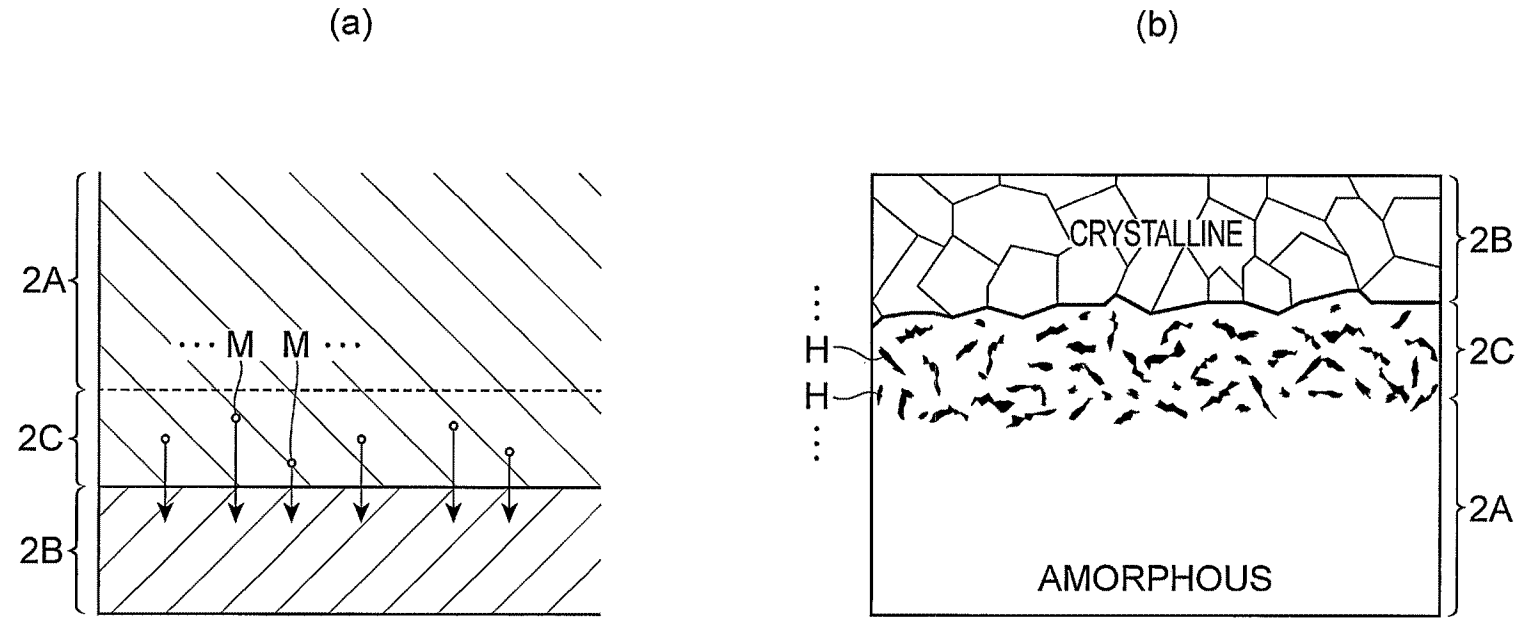
FIG. 7 is a schematic diagram illustrating a phase in which a stress relaxation layer is formed, and an enlarged view illustrating a phase of each layer.

Specifically, the stress relaxation layer 2C is formed when an amorphous ceramic layer configuring the coil unit arrangement layer 2A has a lot of pores therein. When the ceramic green sheet of the coil unit arrangement layer 2A having the above-described composition and the ceramic green sheet of the reinforcement layer 2B having the above-described composition are laminated and the resultant laminated body is baked, as illustrated in FIG. 7(*a*), diffusion of K, B or the like takes place near the boundary of both layers. That is, a constituent (indicated by M in the figure), such as K or B, of the coil unit arrangement layer 2A diffuses to the reinforcement layer 2B having less the constituent compared to the coil unit arrangement layer 2A. Accordingly, a constituent, such as K or B is reduced near the boundary of the amorphous layer, balance of a composition is collapsed, and thus the region is not sufficiently sintered. When an insufficient sintering takes place as such, grain growth in the region is not sufficiently carried out, and, as a result, pores H are formed as illustrated in FIG. 7(*b*). An adjustment of porosity of the stress relaxation layer 2C is carried out by adjusting the constituents in the boundary portion of the ceramic green sheet of the coil unit arrangement layer 2A and the ceramic green sheet of the reinforcement layer 2B. When the constituents of both ceramic green sheets are adjusted, a constituent such as K or B diffuses from the reinforcement layer 2B to the coil unit arrangement layer 2A, and thus pores may be formed in the crystalline ceramic layer configuring the reinforcement layer 2B to form the stress relaxation layer 2C. However, a percentage of $K_2$ content of the reinforcement layer 2B is less than a percentage of $K_2$ content of the coil unit arrangement layer 2A, and the stress relaxation layer 2C may be formed in the coil unit arrangement layer 2A.

A method of forming the stress relaxation layer 2C may be adopted in addition to the above-described method of adjusting the constituents of the ceramic green sheet of the coil unit arrangement layer 2A and the ceramic green sheet of the reinforcement layer 2B. For example, a green sheet containing resin particles may be interposed between the ceramic green sheet of the coil unit arrangement layer 2A and the ceramic green sheet of the reinforcement layer 2B. When the green sheet is baked, resin particles are burned down to become pores. Accordingly, a portion of the green sheet becomes the stress relaxation layer 2C. At this time, a constituent of the green sheet is not particularly specified. Alternatively, the ceramic green sheet (insulation paste) of the coil unit arrangement layer 2A and/or the ceramic green sheet (insulation paste) of the reinforcement layer 2B may have a large amount of resin in the boundary portion. Accordingly, since a large amount of resin is contained in the portion, the portion has pores formed therein by baking and becomes the stress relaxation layer 2C. When a large amount of resin is contained to form pores, the amount of the resin is preferably 20 weight % to 30 weight % of the weight of ceramic powder.

The coil unit 3 has the coil conductor 4 related to a winding pack and the coil conductor 5 related to a lead-out portion which is connected with the external electrode 6. The coil conductors 4 and 5 are formed by a conductive paste having, for example, any of silver, copper and nickel as a main constituent. The coil unit 3 is arranged only inside the coil unit arrangement layer 2A and is not arranged in the reinforcement layer 2B and the stress relaxation layer 2C. In addition, any of the coil conductors 4 and 5 in the coil unit 3 is not in contact with the reinforcement layer 2B and the stress relaxation layer 2C. Both end portions of the coil unit 3 in the laminating direction are apart from the reinforcement layer 2B and the stress relaxation layer 2C, the ceramic of the coil unit arrangement layer 2A is arranged between the coil unit 3, the reinforcement layer 2B and the stress relaxation layer 2C. The coil conductor 4 related to a winding pack is configured by forming a conductive pattern having a predetermined winding by use of a conductive paste on the ceramic green sheet which forms the coil unit arrangement layer 2A. The conductive patterns of the layers are connected with each other via through-hole conductors in the laminating direction. In addition, the coil conductor 5 related to a lead-out portion is configured by a conductive pattern in such a manner that an end portion of a winding pattern is extended out to the external electrode 6. A coil pattern of the winding pack, the number of windings, a lead-out position of the lead-out portion or the like is not particularly specified.

A pair of external electrodes 6 is formed to cover both end surfaces facing each other in a direction orthogonal to the laminating direction among end surfaces of the element assembly 2. Each of the external electrodes 6 is formed to entirely cover each of both end surfaces and a portion thereof may go around to other four surfaces from each of both end surfaces. Each of the external electrodes 6 is formed by screen-printing a conductive paste having, for example, any of silver, copper and nickel as a main constituent, or by a dip method.

Next, a method of manufacturing the laminated coil component 1 of the above-described configuration will be described.

First, ceramic green sheets forming the coil unit arrangement layer 2A and ceramic green sheets forming the reinforcement layer 2B are prepared. A ceramic paste is adjusted to have the above-described composition, is molded to have a sheet shape by a doctor blade method or the like and each of the ceramic green sheets is prepared. A composition may be differently adjusted in such a manner that the stress relaxation layer 2C is prone to be formed only near the boundary between the ceramic green sheet of the coil unit arrangement layer 2A and the ceramic green sheet of the reinforcement layer 2B.

Subsequently, each of through-holes is formed by laser processing or the like at a predetermined position on each of the ceramic green sheets which become the coil unit arrangement layer 2A, that is, each of the through-holes is formed at a pre-arranged position where a through-hole electrode is formed. Next, each of the conductive patterns is formed on each of the ceramic green sheets which become the coil unit arrangement layer 2A. Herein, each of the conductive patterns and each of the through-hole electrodes are formed by a screen printing method using a conductive paste which contains silver, nickel or the like.

Subsequently, each of the ceramic green sheets is laminated. At this time, the ceramic green sheet which becomes the coil unit arrangement layer 2A is stacked on the ceramic green sheet which becomes the reinforcement layer 2B, and the ceramic green sheet which becomes the reinforcement layer 2B is stacked thereon. The reinforcement layers 2B formed at a bottom portion and an upper portion may be formed by a piece of ceramic green sheet, or may be formed by a plurality of ceramic green sheets. Next, each of the ceramic green sheets is crimped by exerting pressure thereon in the laminating direction.

Subsequently, a laminated body is baked at a predetermined temperature (for example, approximately 800 to 1,150° C.) to form the element assembly 2. At this time, a set baking temperature is equal to or higher than a softening point of the coil unit arrangement layer 2A, and is set to be lower than a softening point or a melting point of the reinforcement layer 2B. At this time, the reinforcement layer 2B retains a shape of the coil unit arrangement layer 2A. In addition, since a region corresponding to the stress relaxation layer 2C is not sufficiently sintered compared to other regions during baking, sufficient grain growth does not take place, and thus pores are formed. Accordingly, the amorphous coil unit arrangement layer 2A, the crystalline reinforcement layer 2B and the stress relaxation layer 2C having a high porosity are formed.

Subsequently, the external electrodes 6 are formed on the element assembly 2. Accordingly, the laminated coil component 1 is formed. An electrode paste, which has silver, nickel or copper as a main constituent, is coated on each of both end surfaces of the element assembly 2 in the longitudinal direction, baking is carried out at a predetermined temperature (for example, approximately 600 to 700° C.), and electroplating is carried out to form the external electrode 6. Cu, Ni, Sn and the like can be used for the electroplating.

Next, an operation and effect of the laminated coil component 1 according to the third embodiment will be described.

Smoothness of the surface of a coil conductor is preferably improved to increase a Q (quality factor) value of a coil. The higher a frequency becomes, the shallower skin depth becomes, and smoothness of the surface of a coil conductor affects a Q value at a high frequency. For example, when, as illustrated in FIG. 2(*b*), smoothness of the surface of a coil conductor is deteriorated and concavity and convexity are formed, surface resistance of the coil conductor is increased and a Q value of a coil is decreased. On the other hand, when smoothness of the surface of a coil conductor is improved as illustrated in FIG. 2(*a*), surface resistance of the coil conductor is decreased and a Q value of a coil can be increased.

It is effective to make a ceramic of an element assembly amorphous to improve smoothness of the surface of a coil conductor. When an element assembly is crystalline as illustrated in FIG. 3(*a*), concavity and convexity of the surface of a coil conductor becomes large due to concavity and convexity of the surface of the element assembly in contact therewith, and thus smoothness is deteriorated. On the other hand, when an element assembly is amorphous as illustrated in FIG. 3(*b*), the surface of a coil conductor becomes smooth due to a smooth surface of the element assembly in contact therewith, and thus smoothness is improved.

Herein, the inventors find a problem that, when the element assembly is amorphous, strength of the element assembly becomes weak, and thus cracking or chipping is caused by external stress or impact. As a result of intensive research, the inventors come to find a preferred configuration of the laminated coil component 1.

In the laminated coil component 1 according to the embodiment, the element assembly 2 includes the coil unit arrangement layer 2A which has the coil unit 3 arranged therein, and the reinforcement layer 2B which reinforces the coil unit arrangement layer 2A. Since the coil unit arrangement layer 2A is an amorphous layer which is made from glass-ceramic, smoothness of the surfaces of the coil conductors 4 and 5 arranged therein can be improved, and thus a Q value of the laminated coil component 1 can be increased. In addition, since the reinforcement layer 2B is a crystalline layer, the reinforcement layer 2B can reinforce the amorphous coil unit arrangement layer 2A. Furthermore, the element assembly 2 includes the stress relaxation layer 2C between the coil unit arrangement layer 2A and the reinforcement layer 2B. Since the stress relaxation layer 2C has a higher porosity than other portions, the stress relaxation layer 2C can mitigate stress exerted on the element assembly 2 with being interposed between the coil unit arrangement layer 2A and the reinforcement layer 2B. Accordingly, a Q value of the laminated coil component 1 can be improved and resistance to stress can be increased.

In the embodiment, the coil unit arrangement layer 2A is not entirely amorphous and includes a crystalline portion by such a small amount (0.5 weight % to 2.5 weight %) that alumina is contained. However, the amount is extremely small, and thus a smooth surface is obtained as illustrated in FIG. 3(*b*). As such, the term "amorphous" herein corresponds to even a case where a crystalline portion is included as far as the portion is small.

The present invention is not limited to the above-described embodiments.

For example, in the above-described embodiments, a laminated coil component having one coil unit is illustrated. However, for example, a laminated coil component may have a plurality of coil units in an array.

In addition, in the first and second embodiments described above, the coil unit arrangement layer 2A is interposed between a pair of shape retention layers 2B on both sides in the laminating direction. However, the shape retention layer 2B may be formed only on one side.

In addition, in the third embodiment, the coil unit arrangement layer 2A is interposed between a pair of reinforcement layers 2B and the stress relaxation layer 2C on both sides in the laminating direction. However, the reinforcement layer 2B and the stress relaxation layer 2C may be formed only on one side. Alternatively, a pair of shape retention layers 2B is formed on both sides in the laminating direction, whereas the stress relaxation layer 2C may be formed only on one side in the laminating direction.

INDUSTRIAL APPLICABILITY

The present invention can be used in a laminated coil component.

REFERENCE SIGNS LIST

1 laminated coil component
2 element assembly
2A coil unit arrangement layer
2B shape retention layer, reinforcement layer
2C stress relaxation layer
3 coil unit
4, 5 coil conductor
6 external electrode

The invention claimed is:

1. A laminated coil component comprising:

an element assembly formed by laminating a plurality of insulation layers; and a coil unit formed inside the element assembly by a plurality of coil conductors, wherein the element assembly includes a coil unit arrangement layer which has the coil unit arranged therein, and at least a pair of shape retention layers which is provided to have the coil unit arrangement layer interposed therebetween, wherein the shape retention layer is made from glass-ceramic containing SrO, wherein the coil unit arrangement layer is made from glass-ceramic and contains no SrO, whereby a softening point of the coil unit arrangement layer is lower than a softening point or a melting point of the shape retention layers such that the pair of shape retention layers retain a shape of the coil unit arrangement layer when the element assembly is heated between the softening point of the coil unit arrangement layer and the softening point or the melting point of the shape retention layers, and wherein no conductor is arranged in the shape retention layers.

2. The laminated coil component according to claim 1, wherein the coil unit arrangement layer contains 86.7 weight % to 92.5 weight % of $SiO_2$.

3. The laminated coil component according to claim 1, wherein the coil unit arrangement layer contains 0.5 weight % to 2.4 weight % of $Al_2O_3$.

* * * * *